US008584319B1

(12) United States Patent
Ludin et al.

(10) Patent No.: US 8,584,319 B1
(45) Date of Patent: Nov. 19, 2013

(54) SELF-ALIGNING HINGE

(75) Inventors: Douglas Ludin, Malvern, PA (US); Matthew S. Stauffer, West Chester, PA (US)

(73) Assignee: The Boeing Company, Chicago, IL (US)

( * ) Notice: Subject to any disclaimer, the term of this patent is extended or adjusted under 35 U.S.C. 154(b) by 19 days.

(21) Appl. No.: 13/315,891

(22) Filed: Dec. 9, 2011

(51) Int. Cl.
*E05D 7/10* (2006.01)

(52) U.S. Cl.
USPC ..... 16/266; 16/262; 16/267

(58) Field of Classification Search
USPC ..... 16/266, 267, 268, 269, 225, 386, 387, 16/254, 262; 220/826, 840, 841, 842, 743, 220/844, 908, 4.22, 4.23; 264/238, 242, 264/271.1, 273–279, 328.1, 523; 425/438, 425/400, 401, 442, 522
See application file for complete search history.

(56) References Cited

U.S. PATENT DOCUMENTS

| | | | | | |
|---|---|---|---|---|---|
| 2,618,809 | A | * | 11/1952 | Rubinoff | 16/267 |
| 3,126,120 | A | * | 3/1964 | Crate | 220/844 |
| 4,466,541 | A | * | 8/1984 | Tabler et al. | 206/506 |
| 4,741,032 | A | * | 4/1988 | Hampton | 379/413.02 |
| 5,070,577 | A | * | 12/1991 | Bonneville et al. | 16/260 |
| 5,269,046 | A | * | 12/1993 | Newby, Sr. | 16/267 |
| 5,455,987 | A | * | 10/1995 | Svehaug | 16/267 |
| 6,000,550 | A | * | 12/1999 | Simpson et al. | 206/711 |
| 6,282,751 | B1 | * | 9/2001 | Thometschek et al. | 16/254 |
| 6,461,026 | B1 | * | 10/2002 | Wang | 362/374 |
| 6,684,569 | B2 | | 2/2004 | Gineris et al. | |
| 6,918,508 | B2 | * | 7/2005 | Hwang | 220/826 |
| 2003/0066165 | A1 | | 4/2003 | Hansen, II et al. | |
| 2011/0094059 | A1 | * | 4/2011 | Sze | 16/386 |

FOREIGN PATENT DOCUMENTS

| | | | |
|---|---|---|---|
| DE | 2748185 | A * | 5/1979 |

* cited by examiner

*Primary Examiner* — Chuck Mah
(74) *Attorney, Agent, or Firm* — Christopher J. Knors; Moore & Van Allen PLLC

(57) ABSTRACT

A hinge is disclosed comprising one or more first hinge segments comprising a first surface having disposed thereon: a plurality of spatially separated first lugs each having a first slot formed therein; and a plurality of spatially separated first rods; one or more second hinge segments comprising a second surface having disposed thereon: a plurality of spatially separated second lugs, each second lug having a second slot formed therein; and a plurality of spatially separated second rods. The hinge has a first configuration of partial engagement of the first hinge segment with the second hinge segment where the first slots are aligned and engaged with the second rods; and a second configuration of full engagement of the first hinge segment and the second hinge segment wherein the first slots are rotatably engaged in a direction different than the first configuration.

20 Claims, 6 Drawing Sheets

Related Art
(hinge pin not shown)

FIG. 2
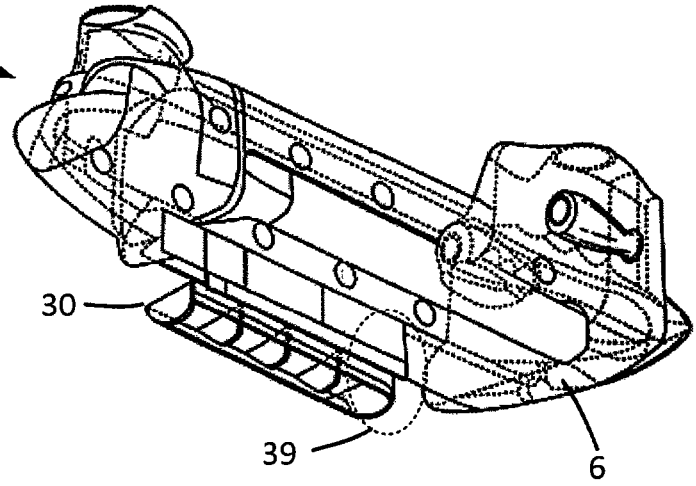
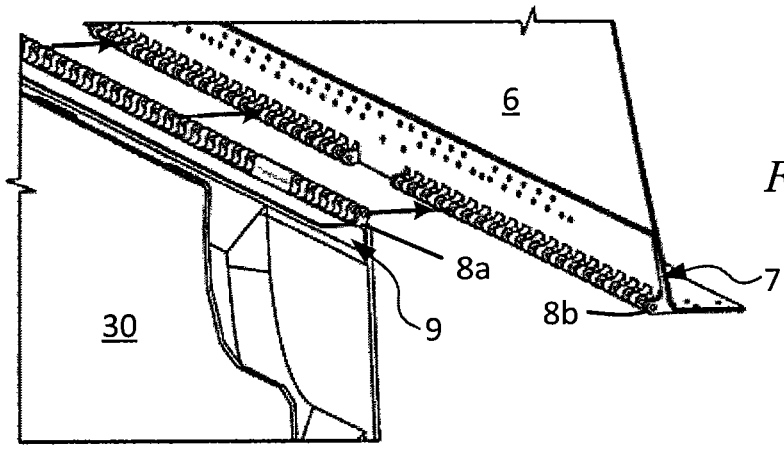
FIG. 3A
FIG. 3B
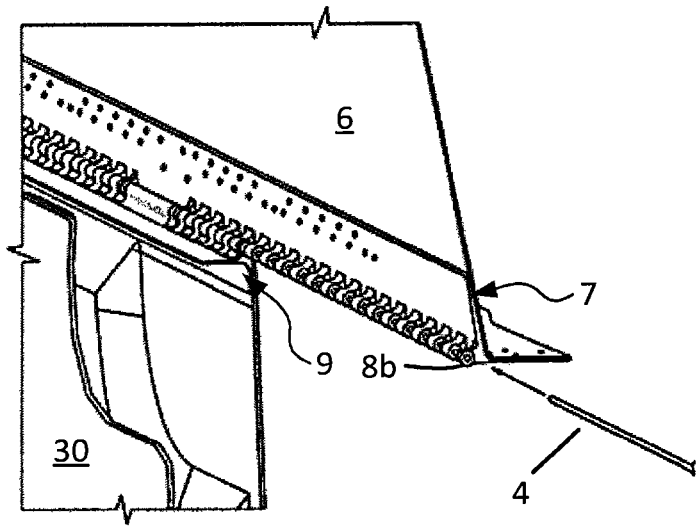

SELF-ALIGNING HINGE

TECHNICAL FIELD

The present invention relates to a self-aligning hinge comprising self-aligning first and second segments, each segment independently having a plurality of spatially separated lugs with slots, and a plurality of spatially separated rods.

BACKGROUND

It is sometimes necessary to couple together a pair of opposite, mating members with a hinge so that the members can be opened from one another, e.g. in the case of a cabin or fuel section, doors, etc, which have to open to provide access, or be removed for repair or replacement. Typically, such hinges are of the conventional "piano" type having a collection of eyed lugs on each hinge segment that are threaded with a separate hinge pin. Such piano hinges (and pins) are typically of long lengths, e.g., over 100 inches or more, require tooling, time and man hours for installation and removal, especially for large, bulky, and/or heavy elements, such as fuel sections, or for doors located about an aerospace vehicle. Moreover, in such arrangements or environments, it may be difficult to maintain a tight fit between the hinged components, particularly if one of the components is damaged, bent, warped, or if the hinge pin is warped or corroded. The problem of properly aligning and providing a uniform and tight fit about the hinge may be further aggravated by such factors as manufacturing tolerances of one or both of the segments, corrosion, dirt, or other foreign objects between the mating halves of the housing.

An example of a structure in which such problems arise is provided by an aerospace vehicle fuselage comprised of hinged mating segments such as a door, pod, ordnance, or other body. The segments are securely hinged to the fuselage e so that access can be provided to the interior of the fuselage (e.g., doors, ramps, etc.) or pods (fuel or ordnance) can be attached/removed. When the mating fuselage/segments are aligned and then pivoted toward each other prior, it is necessary that the components properly align with each other upon alignment and rotation, and that the hinge pin can be properly and efficiently threaded through the length of the hinge so as to form a uniform, tight fit about the entire mating interface.

While, such a fit can be provided using a conventional piano hinge of rigid, inflexible design, such as that shown in FIG. 1, (hinge pin not shown) provided that the corresponding mating segments 1, 2 are manufactured to provide hinge elements within very close tolerance to receive a hinge pin. Such hinges are provided as a set with corresponding length pin, in extended lengths that are difficult to replace, requiring the entire hinge (and pin) to be removed if even only a small portion is damaged. FIG. 2 represents a current application of hinge similar to that of FIG. 1 used in the aerospace industry. It has been found to be somewhat limiting to implement such piano type hinges on aerospace vehicles, especially for those vehicles in need of rapid deployment or "readiness." Such vehicles and bodies with such piano type hinges installed require achieving the necessary tolerances between mating components of the hinge and/or require excessive time to align, rotate and insert the hinge pin. For example, hinges and corresponding hinge pins of long, extended lengths (e.g. hundred or more inches) require power tools for installation.

SUMMARY

In a first embodiment, a hinge is provided. The hinge comprises one or more first hinge segments comprising a first surface having disposed thereon: a plurality of spatially separated first lugs each having a first slot formed therein; and a plurality of spatially separated first rods. The hinge comprises one or more second hinge segments comprising a second surface having disposed thereon: a plurality of spatially separated second lugs, each second lug having a second slot formed therein; and a plurality of spatially separated second rods. The hinge has a first configuration of partial engagement of the first hinge segment with the second hinge segment wherein each of the first slots is aligned and engaged with each of the second rods; and a second configuration of full engagement of the first hinge segment and the second hinge segment wherein each of the first slots is rotatably engaged in a direction different than the first configuration of partial engagement, whereby disengagement of the first hinge segment is prevented.

In a second embodiment, an aerospace vehicle comprising a hingeably attached body attached with a hinge is provided. The hinge comprises one or more first hinge segments comprising a first surface having disposed thereon: a plurality of spatially separated first lugs each having a first slot formed therein; and a plurality of spatially separated first rods; and one or more second hinge segments comprising a second surface having disposed thereon: a plurality of spatially separated second lugs, each second lug having a second slot formed therein; and a plurality of spatially separated second rods. In a first configuration of partial engagement of the first hinge segment with the second hinge segment, each of the first slots is aligned and engaged with each of the second rods. In a second configuration of full engagement of the first segment and the second hinge segment, each of the first slots is rotatably engaged in a direction different than the first configuration of partial engagement.

In a third embodiment, a method of self-aligning a hinge assembly, the method comprising: (i) providing a hinge comprising: one or more first hinge segments comprising a first surface having disposed thereon: a plurality of spatially separated first lugs each having a first slot formed therein; and a plurality of spatially separated first rods; one or more second hinge segments comprising a second surface having disposed thereon: a plurality of spatially separated second lugs, each second lug having a second slot formed therein; and a plurality of spatially separated second rods; (ii) receiving the second rods into the first slots of the first lugs and receiving the first rods into the second slots of the second lugs in an aligned and partially engaged configuration; and (iii) rotating the first segment about its longitudinal axis until the first slots are arranged in a direction different than the second slots.

BRIEF DESCRIPTION OF THE DRAWINGS

The foregoing and other objects, features and advantages of the present disclosure will be apparent from the following more particular description of an exemplified embodiment as illustrated in the accompanying drawings, in which:

FIG. 2 is a side perspective view of a related art aerospace vehicle 5 with hinged body 30 on fuselage 6;

FIG. 3A is an exploded view of section 39 of FIG. 2, showing related art hinge comprising first hinge member 9 with lugs 8*a* attached to body 30, and second hinge member 7 with lugs 8*b* in an alignment configuration;

FIG. 3*b* is an exploded view of section 39 of FIG. 2, showing related art hinge comprising first hinge member 9 with lugs 8*a* attached to body 30, and second hinge member 7 with lugs 8*b* attached to fuselage 6 in a fully engaged configuration with hinge pin 4 positioned for threading;

DETAILED DESCRIPTION

Figure 1:
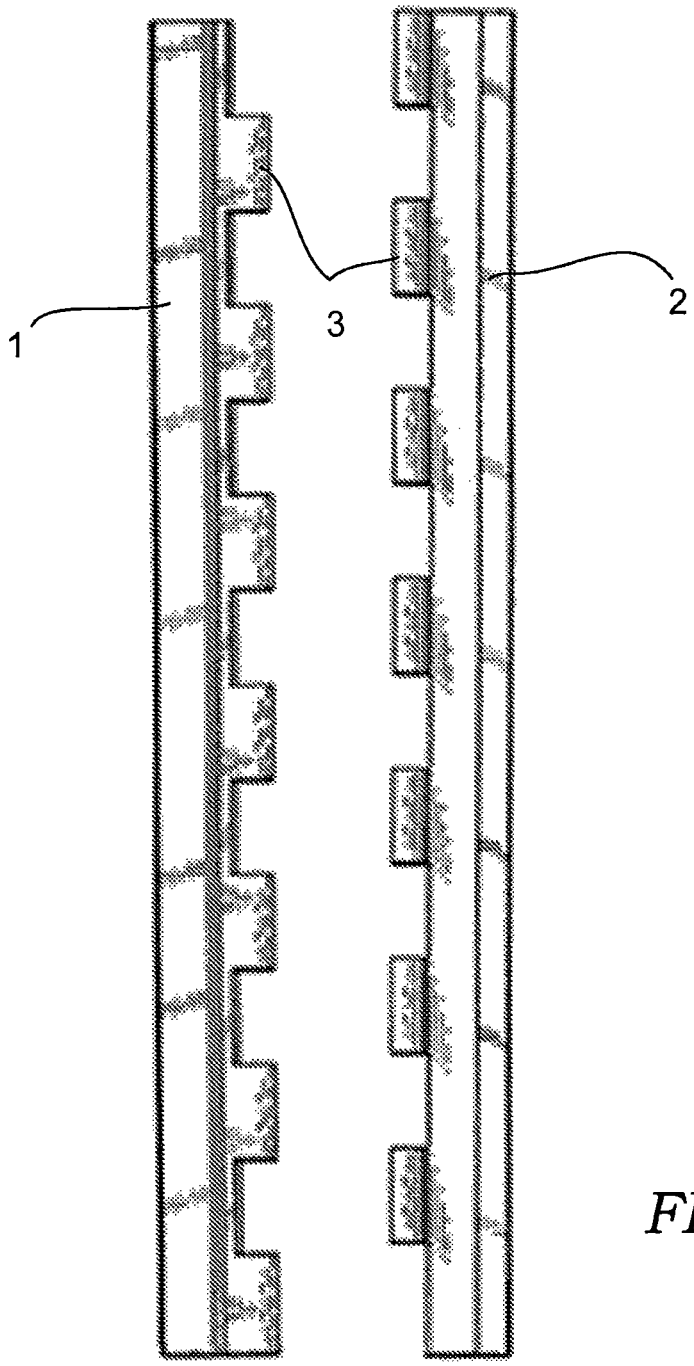
FIG. 1 is a front view of a related art "piano hinge" having first hinge member 1, and second hinge member 2, each having lugs 3 for receiving a hinge pin (not shown)

The terminology used herein is for the purpose of describing particular embodiments only and is not intended to be limiting of the inventive subject matter. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

When an element such as a body, segment, or fixture is referred to herein as being "on" or extending "onto" another element, it can be directly on or extend directly onto the other element or intervening elements may also be present. In contrast, when an element is referred to herein as being extending "directly onto" another element, there are no intervening elements present. Also, when an element is referred to herein as being "connected" or "coupled" to another element, it can be directly connected or coupled to the other element or intervening elements may be present. In contrast, when an element is referred to herein as being "directly connected" or "directly coupled" to another element, there are no intervening elements present. In addition, a statement that a first element is "on" a second element is synonymous with a statement that the second element is "on" the first element. Although the terms "first", "second", etc. may be used herein to describe various elements, components, regions, segments, sections and/or parameters, these elements, components, regions, segments, sections and/or parameters should not be limited by these terms. These terms are only used to distinguish one element, component, region, segment, or section from another region, segment, or section. Thus, a first element, component, region, segment, or section discussed below could be termed a second element, component, region, segment, or section without departing from the teachings of the present disclosure.

Relative terms, such as "lower", "bottom", "below", "upper", "top" or "above," may be used herein to describe one element's relationship to another element as illustrated in the Figures. Such relative terms are intended to encompass different orientations of the aspects disclosed in addition to the orientation depicted in the Figures. For example, if the apparatus in the Figures is turned over, elements described as being on the "lower" side of other elements would then be oriented on "upper" sides of the other elements. The exemplary term "lower", can therefore, encompass both an orientation of "lower" and "upper," depending on the particular orientation of the figure. Similarly, if the apparatus in one of the figures is turned over, elements described as "below" or "beneath" other elements would then be oriented "above" the other elements. The exemplary terms "below" or "beneath" can, therefore, encompass both an orientation of above and below.

The term "adjacent", as used herein to refer to a spatial relationship between a first structure and a second structure, means that the first and second structures are next to each other (for example, where two elements are adjacent to each other, no other element is positioned between them).

The present disclosure provides a hinge assembly comprising "built-in" rods and/or lugs on operably mating segments that essentially self-align. The configuration of elements embodied in the instant disclosure permits easy, tool-less engagement of the hinge halves that positively lock/engage. The configuration further provides for engagement/locking by rotating one hinge segment (half). The present disclosure provides a hinge assembly that can be used as a direct replacement of or in combination with a piano-hinge type hinge.

The presently disclosed configuration provides a hinge assembly comprising multiple spatially separated rods and lugs on each hinge segment. Slots in the lugs are differently oriented on each hinge segment. Thus, in one aspect, multiple separated rod and lug segments on each hinge segment are arranged to fit into a mirror image-like hinge once aligned and engaged, allowing for one hinge segment to be rotated such that the slots of one segments lugs are un-aligned relative to the other hinge segment's slots. In this configuration, the un-aligned slots prevents the lugs from releasing from the rods. This instant configuration of slots provides for acceptance of minor misalignment of hinge segments (halves) and provides for self-alignment at engagement. Rotation of one of the hinge segments after engagement provides a fully engaged configuration and permits load bearing capability. The deployment of a plurality of discrete rods removes single point of failure. In addition, no special tools would be required for installation, alignment, and locking of the assembly.

The presently disclosed hinge assembly can be employed generally as a replacement of (or addition to) other types of hinges. In one aspect, the presently disclosed hinge assembly is employed for installing and securing bodies (e.g., fuel pods, hatches, ordnance supports, etc.) for an aerospace vehicle. Methods of hingeably attaching bodies to aerospace vehicles using the presently disclosed hinge assembly provides reduction in the time to assemble, tool-less installation, greater tolerance for misaligned and/or warped hinge elements, elimination of a single, long hinge pin, and the use of a plurality of short sections providing rapid replacement of damaged hinge sections.

In one aspect, the disclosed hinge assembly can be employed on helicopter vehicles. The hinge assembly can simplify the structural installation of various bodies to the fuselage of the helicopter. In one example, the hinge assembly can provide rapid installation of fuel pods to helicopters, such as the CH-47, as well as other bodies.

With reference to FIG. 2, a related art method and related art hinge assembly is depicted for installation of body 30 (e.g., fuel pod) with hinge member 9, of an aerospace vehicle 5, (e.g., a CH-47 helicopter) on fuselage 6 having continuous length piano hinge member 7, which typically can be up to 110 inches long. Hinge pin 4, which must be installed after alignment of hinge members 7 and 9, are typically four (4) 24+ inch segments possibly needing the use of power tools. Aligning hinge lugs 8*a* and 8*b* are typically about 0.5 inches long.

FIGS. 3A-3B shows the alignment-engagement of corresponding lugs 8*a*, 8*b* of fuel pod 3 and the threading of hinge pin 4, is a process that is difficult and time-consuming due to various misalignments, e.g., fuselage sag that deflects continuous piano hinge half and/or lugs, fuel pod warpage that deflects continuous piano hinge half and/or lugs, and difficulty installing 24 inch or greater hinge pins through greater than 100 hinge lugs holes requiring power tools.

Figure 4:
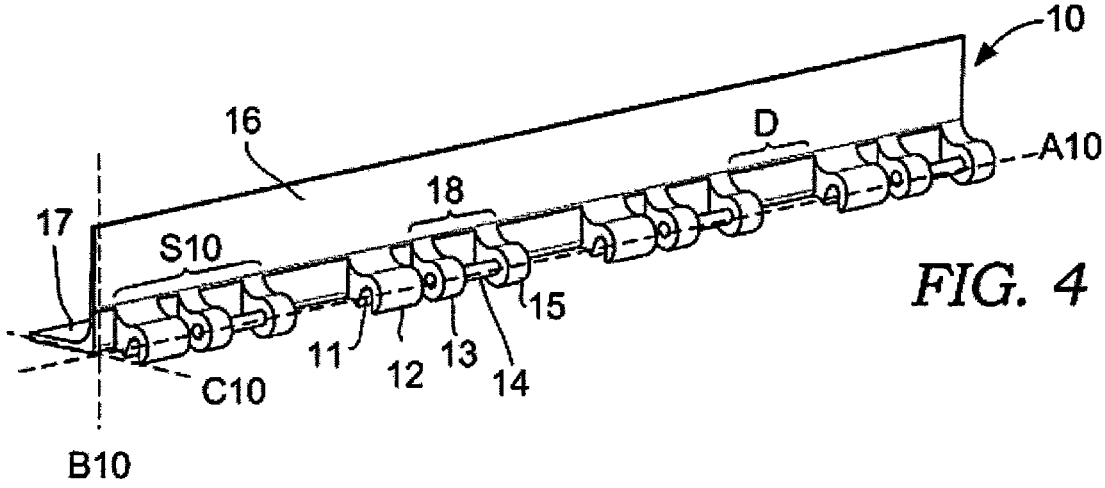
FIG. 4 is a perspective view of a hinge segment embodiment disclosed and described herein.
Figure 5:
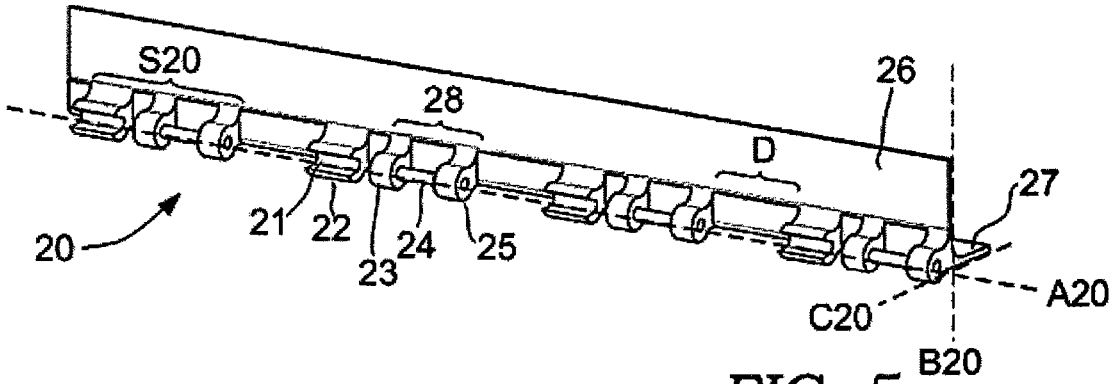
FIG. 5 is a perspective view of a hinge segment embodiment disclosed and described herein operably corresponding to the hinge segment of FIG. 4.

In contrast to the related piano hinge as depicted in FIGS. 1-3, and providing improvement in function and design, an embodiment of the instant hinge is shown in FIGS. 4-5. Thus, with reference to FIG. 4, first hinge segment 10 comprising first surface 16 having a longitudinal axis (along A10) has a plurality of spatially separated first lugs 12 having a first slot 11, and a plurality of spaced apart first rods 14, projecting from first surface 16 along axis C10. First surface 16 is shown projecting along axis B10, and can be used to mount or otherwise fasten the first hinge segment to a body, for example, a body to be hingeably connected to another object. First projecting surface 17 of first segment 10 is shown projecting along axis C10 and providing an L-like configuration with vertex (shown at the intersection of B10 and C10 in FIG. 4). First segment 10 comprises two facing first members 13, 15, with first rods 14 extending between the two facing first members separated a predetermined length 18. Rods 14 each have longitudinal axes that are essentially collinear and/or coplanar along with longitudinal axis A10. First slots 11 are shown with each having a first direction transverse to the longitudinal axis of the slot.

With reference to FIG. 5, second hinge segment 20 comprising a second surface 26 having a longitudinal axis (along A20) has a plurality of spatially separated second lugs 21 having second slot 21, and a plurality of spaced apart second rods 24, projecting from second surface 26 along axis C20. Second segment 20 comprises two facing second members 23, 25, with second rod 24 extending between the two facing second members a predetermined length 28. Second rods 24 and second slots 21 are shown each having longitudinal axes that are essentially collinear and coplanar along longitudinal axis A20. Second slots 21 have a second direction transverse the longitudinal axis of the second slot that is different than the first direction of first slots 11. Second surface 26 is shown projecting along axis B20, and can be used to mount or otherwise fasten second hinge segment 20 to an object, for example, an object to hingeably receive another object. First hinge segment 10 and second hinge segment 20 comprises a "hinge assembly" for use in combination to hingeably engage a body to an object.

The first surface 16 and the first projecting surface 17 (or second surface 26 and the second projecting surface 27) forms a vertex. In one aspect as shown in FIGS. 4-5, first and second lugs 12, 22, and respective facing members 13, 15, and 23, 25 can be configured to project from the proximity of the vertex of the projecting surfaces. In one aspect, the first segment 10 and/or second segment 20 are arranged in an L-like configuration, e.g., as exemplified in FIGS. 4-5. Each of the first segment 10 and the second segment 20 can comprises a plurality of spatially separated pairs S10, S20, respectively, of a single lug adjacent a single rod (and corresponding facing members). Such pairs of lug/rod/facing members can be separated a predetermined distance D, which can be constant or variable along the longitudinal length of the segment. The arrangement of lugs/rods with facing members can be altered from that depicted in the drawings, for example, a predetermined number of sequentially spaced lugs spatially separated from a predetermined number of sequentially spaced rods and facing members (e.g., at least some non-adjacent lugs/rods). Other arrangements of lugs/rods with facing members can be used.

Facing first members 13, 15, and facing second members 23, 25, and first rod 14 and second rod, 24, can be configured, independently, with identical facing member separation distance, rod length, and/or rod diameter. Alternatively, they can be, independently configured with different rod lengths, rod diameters, and/or facing member widths, providing both segments of the assembly are cooperatively arranged for alignment configuration and locking configuration as described below. Rods 14, 24 can be positionally and/or rotationally fixed, or can be free to rotate about their longitudinal axis while extending between facing members 13, 15, 23, 25.

Each of the first rods 14 and/or second rods 24 comprises a rod diameter, measured transverse to the rod longitudinal axis. Each of the first lug slots 11 and/or the second lugs slots 21 can be configured larger than the corresponding rod diameter to facilitate ease of alignment, engagement, and locking. In another aspect, one or more lugs can be configured of slightly smaller diameter and/or of a resilient material so as to snap-fit or otherwise provide an audible indication of engagement of the hinge segments.

Figure 6:
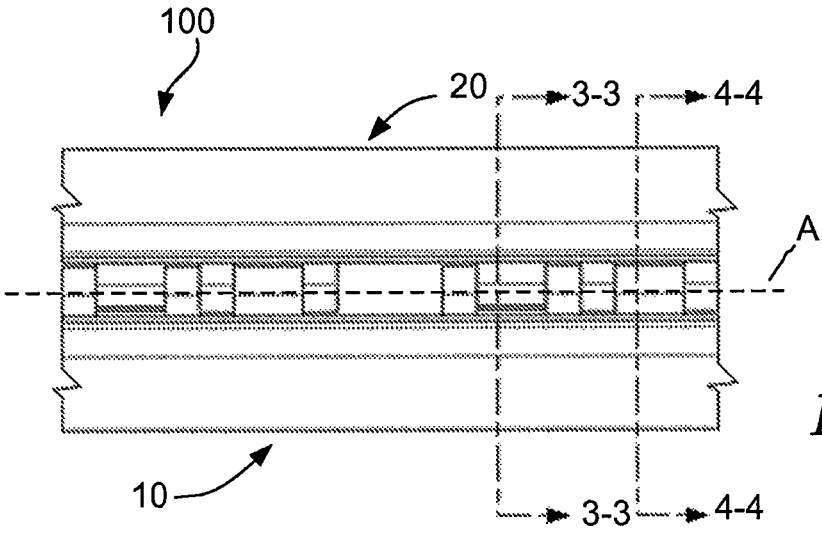
FIG. 6 is top plan view of a hinge assembly embodiment in a fully engaged configuration disclosed and described herein.
Figure 7:
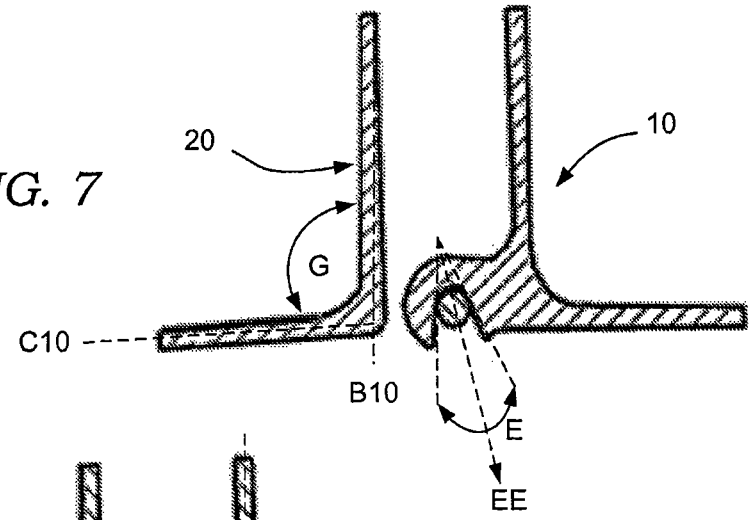
FIG. 7 is a section view along line 3-3 of FIG. 6.

FIG. 6 depicts hinge assembly 100, shown in a fully engaged configuration of first segment 10 and second segment 20. FIG. 7 is a sectional view of FIG. 6 taken along line 3-3 and depicts the arrangement and direction of first slots 11 of segment 10 in a fully engaged configuration containing second rod 24 of second segment 20. First slot 11 direction can be represented by directional vector EE, which bisects angle E formed by the first slot walls. Directional vector EE is transverse to the longitudinal axis of first slot 11.

Figure 8:
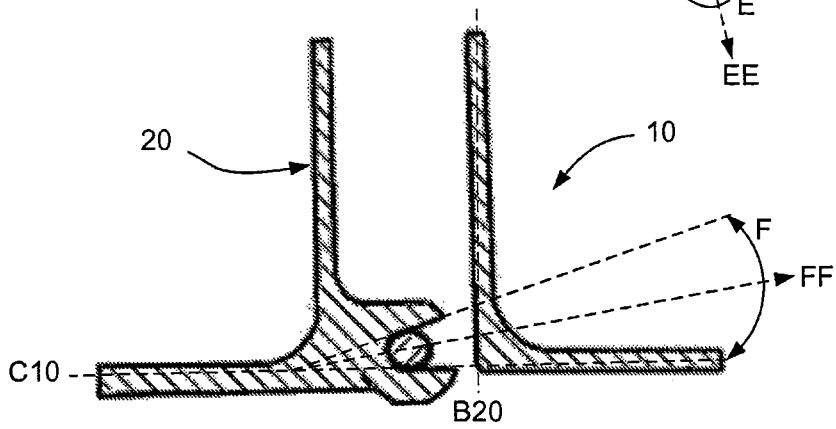
FIG. 8 is a sectional view along line 4-4 of FIG. 6.

FIG. 8 is a sectional view of FIG. 6 taken along line 4-4 and depicts the arrangement and direction of second slot 21 of second segment 20 in a fully engaged configuration containing first rod 14 of first segment 10. Second slot 21 direction can be represented by directional vector FF, which bisects angle F formed by the second slot walls. Directional vector FF is transverse to the longitudinal axis of second slot 21.

As shown in FIGS. 7 and 8, the direction of first slots 11 and second slots 21 are different in the fully engaged configuration (e.g., directional vectors EE and FF in the fully engaged configuration of assembly 100 are not co-parallel). In one aspect, directional vectors EE and FF (projected in a common plane) in the fully engaged configuration can differ in their angular relationship to each other by about 30 degrees to about 150 degrees ("about" being inclusive of +/−10 degrees). In another aspect, directional vectors EE and FF in the fully engaged configuration can differ in their angular relationship to each other by about 80 degrees to about 100 degrees. In yet another aspect, directional vectors EE and FF in the fully engaged configuration can differ by about 85 degrees to about 95 degrees.

The first surface 16 and the first projecting surface 17 of first hinge segment 10 form angle G, and the second surface 26 and the second projecting surface 27 of the second hinge segment 20 form angle H. Angles G, H can, independently, be acute, normal, or obtuse as needed to mount to a structure or body.

Figure 9:
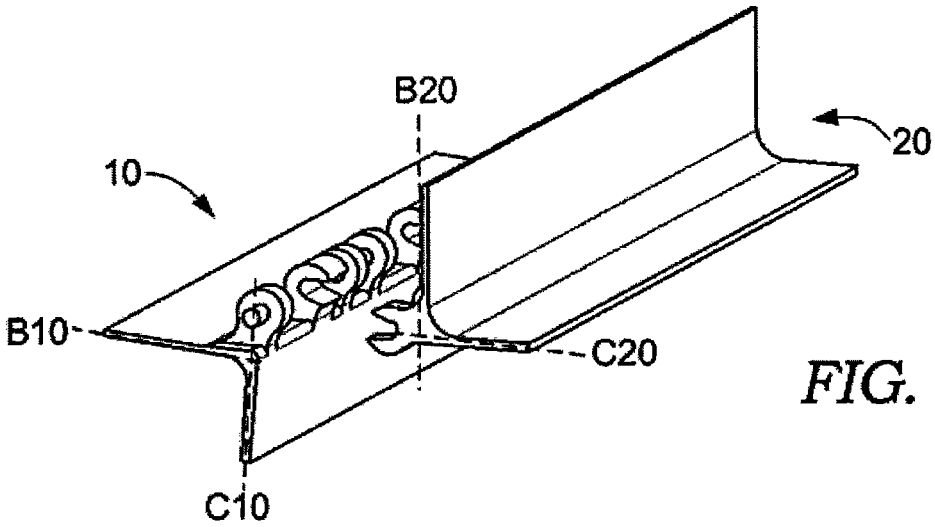
FIG. 9 is a perspective view of a hinge assembly embodiment in an alignment configuration as disclosed and described herein.
Figure 10:
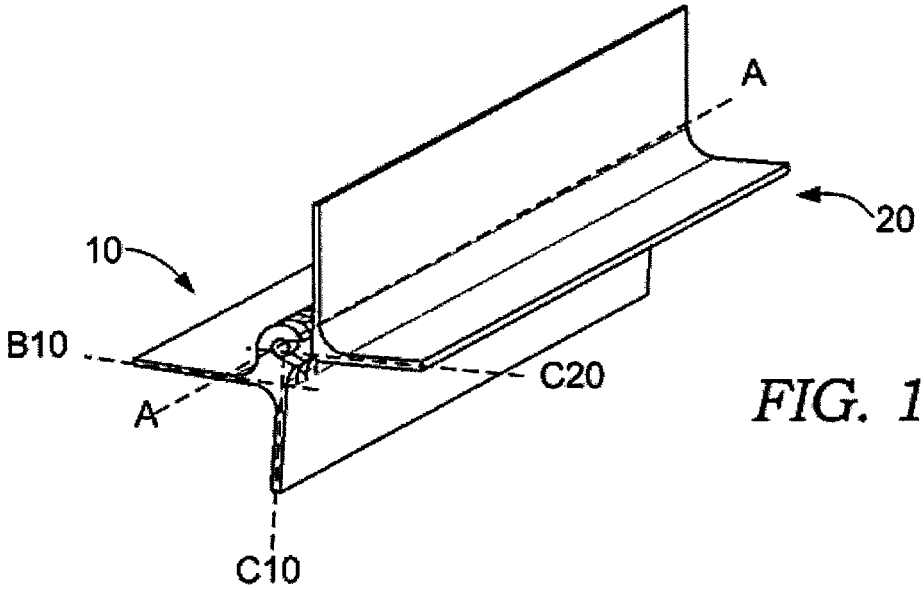
FIG. 10 is a perspective view of the hinge assembly embodiment of FIG. 9 in a fully engaged configuration as disclosed and described herein.
Figure 11:
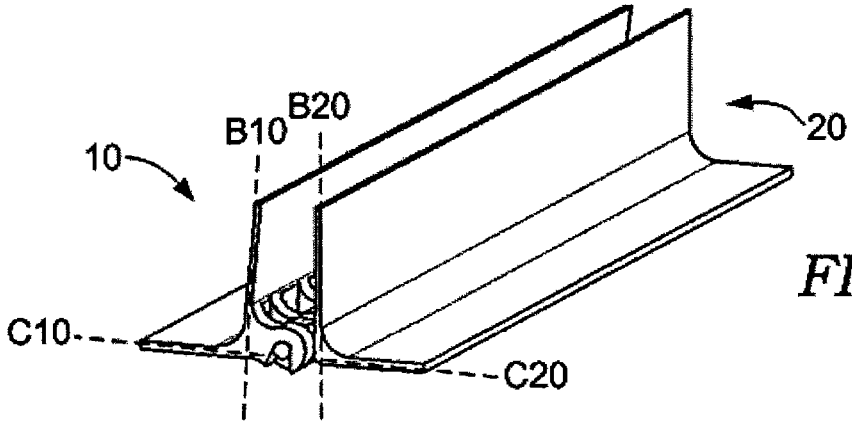
FIG. 11 is a perspective view of a hinge assembly embodiment in a fully engaged configuration as disclosed and described herein.

FIGS. 9-10 depict, in an exemplary embodiment, the method of self-aligning configuration, engaging configuration, and fully engaged configuration of the presently disclosed hinge assembly 100. FIG. 9 depicts first hinge segment 10 with first surface 16 (along axis B10) being aligned essentially coplanar with (e.g., stationary) second projecting surface 27 of hinge segment 20 (along axis C20). In this alignment configuration, first slots 11 of first segment 10 can receive second rods 24 of second segment 20, while first rods 14 of first segment 10 can be received by second slots 21 of second segment 20. FIG. 10 depicts the engaged configuration of first hinge segment 10 and second hinge segment 20 of assembly 100. FIG. 10 depicts the fully engaged configuration of assembly 100, where rotation of first hinge segment 10 about axis A brings first surface 16 essentially parallel with second surface 26 of second segment 20, first slots 11 are oriented with their direction opposed to second slots 21, preventing disengagement of the segments from each other. Holes can be pre-formed in either surface of segments 10 or 20 for facilitating mounting and/or securing to a structure or body.

Figure 12:
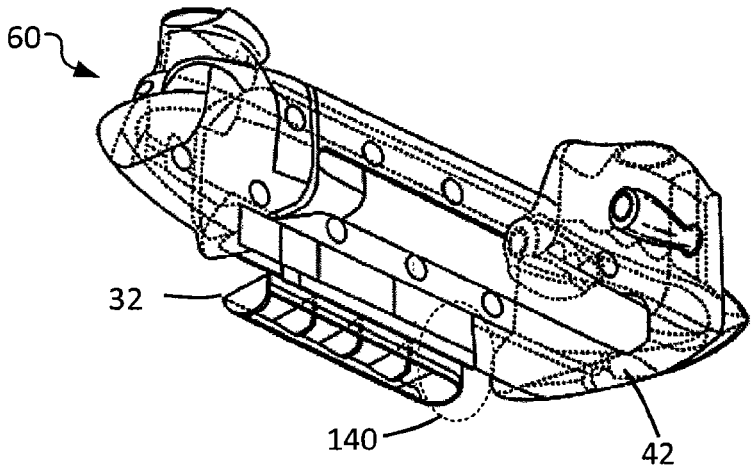
FIG. 12 is a side perspective view of an aerospace vehicle embodiment with a hinge assembly embodiment as disclosed and described herein.
Figure 13:
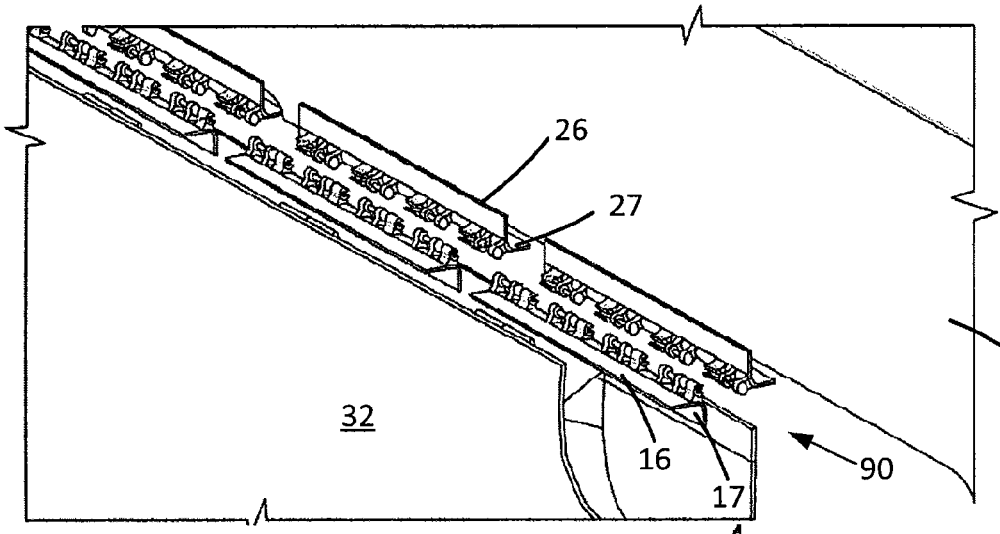
FIG. 13 is an exploded view of section 140 of FIG. 12, showing the hinge embodiment in an alignment state as disclosed and described herein.

FIGS. 12-13 depict an exemplary application of hinge assembly 100 used in securing a body 32 (e.g., fuel pod) to an aerospace vehicle 60. Thus, aerospace vehicle 60 (e.g., helicopter) with hingeably attached body 32 (e.g., fuel pod) is shown in FIG. 12. Exploded section view of area 140 of FIG. 12 is shown in FIG. 13 in an alignment configuration, where one or more of first segments 10 are mounted to body 32 with first surface 16 and first slots 11 coplanar with one or more of second segments 20 mounted to fuselage 42 of aerospace vehicle 60.

Figure 14:
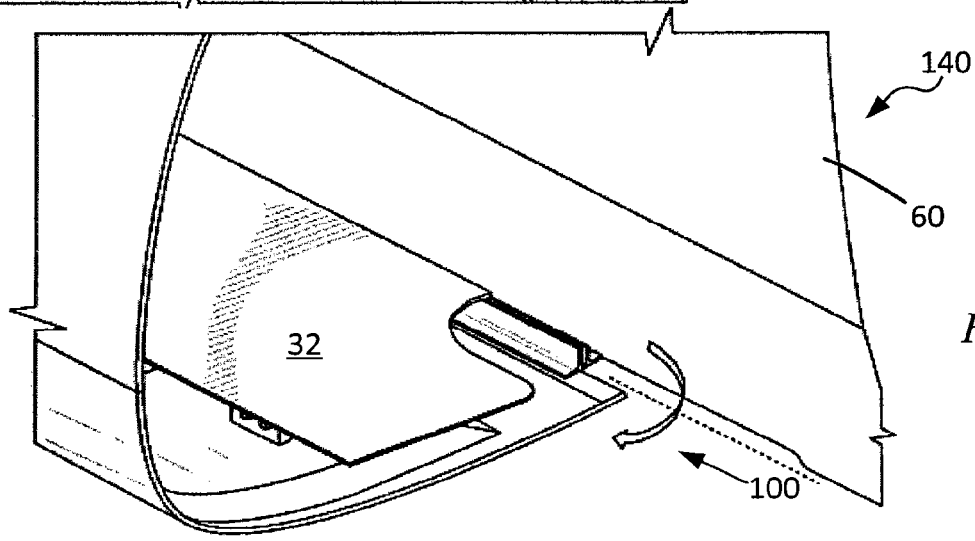
FIG. 14 is an exploded view of section 140 of FIG. 12, showing the hinge embodiment in a fully engaged configuration as disclosed and described herein.

After alignment of first slots 11 with second rods 24, first hinge segment 10, together with body 32, is rotated to the fully engaged configuration as described above to provide self-aligning hinge assembly 100 on the aerospace vehicle. The presently disclosed hinge assembly provides for design flexibility for longer fuel pods for aerospace vehicles that can be installed with the same basic aerospace attachment design, more efficiently, and without special tooling. FIG. 14 is an exploded view of section 140 of FIG. 12, showing the hinge embodiment in a fully engaged configuration. Other applications of the presently disclosed hinge assembly in addition to main or auxiliary fuel pod installations include, for example, refueling station doors, pylon clamshell doors, and pylon work platform doors.

Of course, the hinge assembly herein disclosed can also be used for providing the functionality of a hinged arrangement of parts of any kind, including for example, doors, hatches, and the like. The hinge assembly can be arranged and/or used in any orientation, e.g., vertically, horizontally, diagonally, etc. The hinge segment, lugs, rods, and other components, independently or in combination, can be fabricated from metal, plastic, composite, ceramic, wood, or combination.

Furthermore, while certain embodiments of the present disclosure have been illustrated with reference to specific combinations of elements, various other combinations may also be provided without departing from the teachings of the present disclosure. Thus, the present disclosure should not be construed as being limited to the particular exemplary embodiments described herein and illustrated in the Figures, but may also encompass combinations of elements of the various illustrated embodiments and aspects thereof.

We claim:

1. A hinge comprising:

one or more first hinge segments comprising a first surface having supported thereon:

a plurality of spatially separated first lugs each having a first slot formed therein; and a plurality of spatially separated first rods and, each of said first slots being defined by two first slot walls and having a first directional vector which bisects an angle formed by the first slot walls;

one or more second hinge segments comprising a second surface having supported thereon: a plurality of spatially separated second lugs, each second lug having a second slot formed therein; and a plurality of spatially separated second rods, each of said second slots being defined by two second slot walls and having a corresponding second directional vector which bisects an angle formed by the second slot walls;

the first hinge segments and the second hinge segments positionable between a first configuration and a second configuration wherein the first configuration is of partial engagement of the first hinge segment with the second hinge segment wherein each of the first slots is aligned and engaged with each of the second rods and wherein the first directional vectors and the second directional vectors project in a common plane; and the second configuration is of full engagement of the first hinge segment and the second hinge segment wherein each of the first slots is rotatably engaged and each of the first directional vectors project in a different direction than each of the second directional vectors, whereby disengagement of the first hinge segment is prevented.

2. A hinge of claim 1, wherein the first directional vectors and the second directional vectors have an angular difference in the fully engaged configuration of about 30 degrees to about 150 degrees.

3. A hinge of claim 2, wherein the angular difference is about 80 degrees to about 100 degrees.

4. A hinge of claim 1, wherein, the plurality of supported spatially separated first lugs and the plurality of supported spatially separated first rods are arranged as a plurality of spatially separated pairs of lugs adjacent a corresponding single rod and the plurality of supported spatially separated second lugs and the plurality of supported spatially separated second rods are arranged as a plurality of spatially separated pairs of lugs adjacent a corresponding single rod.

5. A hinge of claim 1, wherein each of the plurality of first rods extend between two facing first members, and wherein each of the plurality of second rods extend between two facing second members.

6. A hinge of claim 1, wherein either the first surface and/or the second surface comprises, independently, an additional projecting surface therefrom forming a vertex.

7. A hinge of claim 6, wherein the first segment and/or second segment are arranged in an L-like configuration.

8. A hinge of claim 1, wherein each of the first rods and/or second rods comprise a rod diameter measured transverse to the rod longitudinal axis, and wherein each of the first lug slots and/or the second lugs slots is larger than the corresponding rod diameter.

9. A hinge of claim 1, wherein the first segment is attached to a body and the second segment is attached to an aerospace vehicle.

10. An aerospace vehicle comprising a hingeably attached body attached with a hinge, the hinge comprising:

one or more first hinge segments comprising a first surface having supported thereon: a plurality of spatially separated first lugs each having a first slot formed therein; and a plurality of spatially separated first rods and, each of said first slots being defined by two first slot walls and having a first directional vector which bisects an angle formed by the first slot walls;

one or more second hinge segments comprising a second surface having supported thereon: a plurality of spatially separated second lugs, each second lug having a second slot formed therein; and a plurality of spatially separated second rods, each of said second slots being defined by two second slot walls and having a corresponding second directional vector which bisects an angle formed by the second slot walls;

the first hinge segments and the second hinge segments positionable between a first configuration and a second configuration wherein:

the first configuration is of partial engagement of the first hinge segment with the second hinge segment wherein each of the first slots is aligned and engaged with each of the second rods and wherein the first directional vectors and the second directional vectors project in a common plane; and the second configuration is of full engagement of the first hinge segment and the second hinge segment wherein each of the first slots is rotatably engaged and each of the first directional vectors project in a different direction than each of the second directional vectors, whereby disengagement of the first hinge segment is prevented.

11. An aerospace vehicle of claim 10, wherein the first directional vectors and the second directional vectors have an angular difference in the fully engaged configuration of about 30 degrees to about 150 degrees.

12. An aerospace vehicle of claim 11, wherein angular difference is about 80 degrees to about 100 degrees.

13. An aerospace vehicle of claim 10, wherein the plurality of supported spatially separated first lugs and the plurality of supported spatially separated first rods are arranged as a plurality of spatially separated pairs of lugs adjacent a corresponding single rod and the plurality of supported spatially separated second lugs and the plurality of supported spatially separated second rods are arranged as a plurality of spatially separated pairs of lugs adjacent a corresponding single rod.

14. An aerospace vehicle of claim 10, wherein the first hinge segment further comprises a first projecting surface projecting from the first surface forming a first vertex, the plurality of spatially separated first lugs and the plurality of spatially separated first rods projecting proximal to the vertex.

15. An aerospace vehicle of claim 14, wherein the first surface and the second surface are arranged in an L-like configuration.

16. A method of self-aligning a hinge assembly, the method comprising:

(i) providing a hinge comprising:

one or more first hinge segments comprising a first surface having disposed thereon: a plurality of spatially separated first lugs each having a first slot formed therein; and a plurality of spatially separated first rods, each of said first slots being defined by two first slot walls and having a first directional vector which bisects an angle formed by the first slot walls; and one or more second hinge segments comprising a second surface having disposed thereon: a plurality of spatially separated second lugs, each second lug having a second slot formed therein and a plurality of spatially separated second rods, each of said second slots being defined by two second slot walls and having a second directional vector which bisects an angle formed by the second slot walls;

(ii) receiving the second rods into the first slots of the first lugs and receiving the first rods into the second slots of the second lugs in an aligned and partially engaged configuration; and (iii) rotating the first segment about its longitudinal axis until the first directional vectors are arranged in a direction different than the second directional vectors.

17. A method of claim 16, wherein the angular difference between the first directional vector and the second directional vector in the fully engaged configuration is about 30 degrees to about 150 degrees after step (iii).

18. A method of claim 17, wherein the angular difference is about 80 degrees to about 100 degrees after step (iii).

19. A method of claim 16, wherein the first segment and/or the second component is configured for mounting to an aerospace vehicle and/or an aerospace component thereof.

20. A method of claim 16, wherein each of the plurality of first rods extend between two facing first members, and wherein each of the plurality of second rods extend between two facing second members.

* * * * *